US006308334B1

(12) United States Patent
Maas

(10) Patent No.: US 6,308,334 B1
(45) Date of Patent: Oct. 30, 2001

(54) CONVERTIBLE COSTUME CONSTRUCTION

(76) Inventor: David Maas, 4900 Manatee Ave., West, Suite 161, Bradenton, FL (US) 34209

( * ) Notice: Subject to any disclaimer, the term of this patent is extended or adjusted under 35 U.S.C. 154(b) by 0 days.

(21) Appl. No.: 09/692,584

(22) Filed: Oct. 23, 2000

Related U.S. Application Data

(60) Provisional application No. 60/168,723, filed on Dec. 6, 1999.

(51) Int. Cl.[7] ..... A41D 15/00
(52) U.S. Cl. ..... 2/69; 2/74
(58) Field of Search ..... 2/69, 69.5, 70, 2/71, 72, 73, 74, 88, 89, 212, 213, 308, 741, 273

(56) References Cited

U.S. PATENT DOCUMENTS 1,388,802 * 8/1921 Cooper .
1,695,590 * 12/1928 Jensen .
2,333,603 * 11/1943 Walker ..... 2/132
2,521,020 * 9/1950 Prescott ..... 2/70
2,722,686 * 11/1955 Hoskings ..... 2/74
2,835,897 * 5/1958 Scruggs ..... 2/71
3,116,491 * 1/1964 Previdi et al. ..... 2/106
4,453,274 * 6/1984 Allen ..... 2/102
4,964,173 * 10/1990 Gordon et al. ..... 2/114
5,611,083 * 3/1997 Arnold ..... 2/84
5,611,087 * 3/1997 Adkins ..... 2/114
6,185,743 * 2/2001 Mick ..... 2/84

* cited by examiner

*Primary Examiner*—John J. Calvert
*Assistant Examiner*—Alissa L. Hoey
(74) *Attorney, Agent, or Firm*—Charles E. Temko

(57) ABSTRACT

A costume construction suitable for stage use permitting a rapid change of appearance during a period of temporary concealment of the user to create the illusion of total removal and substitution of a costume. The construction is such that the costume is maintained in position by one or more rapidly disconnectable fastening means permitting the costume to display another garment concealed therebeneath.

4 Claims, 2 Drawing Sheets

CONVERTIBLE COSTUME CONSTRUCTION

This applications claims benefit of 60/168,723, filed Dec. 6, 1999.

BACKGROUND OF THE INVENTION

This invention relates generally to the field of stage costumes, and more particularly to an improve costume construction suitable for use by magicians and the like for creating the appearance of costume transformation from a first to a second appearance, the operation being performed over a very short period of time, during which the performer is concealed from the audience.

The simulation of change of configuration from one appearance to another, almost instantaneously, is a highly developed art in the entertainment arts. Such simulation has employed a variety of techniques, and is most commonly presented in connection with relatively small articles, such as bottles, gloves, coins, and the like, which can be readily concealed on the person of the artist during his presentation. The transformation of a costume in this manner has not been possible because of consideration of size, engagement with the body of the wearer, and the difficulty of disengagement in a rapid fashion. It is known in the art to provide such simulation, using cinematographic techniques which enable editing and discontinuities in filming.

SUMMARY OF THE INVENTION

Briefly stated, the invention contemplates the provision of an improved costume construction including inner and outer garments, the inner garment being concealed from view by the outer garment until the outer garment is removed. The outer garment is held upon the body of the wearer by means of quickly disengageable fastening means at the shoulder and along the sides of the garment. The lower hem of the garment contains weights, so that when the fasteners are disconnected, the garment will fall under the action of gravity to the floor, permitting the inner garment to be immediately displayed. Normally, this operation is conducted within the confines of a cloth shield maintained in upright condition by one or more assistants, and when the shield is dropped, the outer garment will be contained therein, and not exposed to view by the audience. In a preferred embodiment, the outer garment has a relatively short skirt, while the inner garment is a full length garment, with the lower portion thereof held above the waist of the wearer by the waist constriction of the outer garment.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
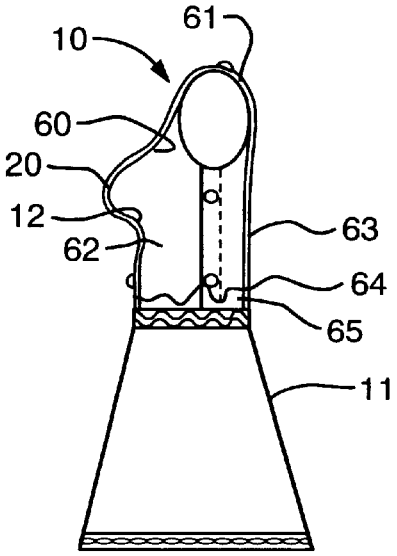
FIG. 1 is a schematic side elevational view of an embodiment of the invention displaying a first costume.

In accordance with the invention, the device, generally indicated by reference character 10, comprises broadly: an outer costume element 11 and an inner costume element 12.

The outer costume element 11 may be in the form of a sleeveless shirt or chemise 20, including separable front and rear members 21 and 22 which are interconnected at a waistband 23 from which a flared skirt 24 depends.

The shirt 20 includes a bodice portion 26, extending from a lower edge 27 to a pair of shoulder straps, one of which is indicated by reference character 28. The front and rear portions of the straps 28 each are provided with an interconnectable terminal 29 having quick detachable means (not shown). Most conveniently, this means is in the form of snap fasteners, hook and pile interconnectable means (Velcro), and the like. The vertical side edges 31 of the shirt 20 are also interconnected by similar means 32.

The waistband 23 includes overlapping terminals 46 in the general area of overlapping vertical seams 47, so that both may be opened in a single manual operation. The skirt 24 includes an outer surface 49 and an inner surface 50 extending to a lower end 51 which contains weights 52 in either spherical or bar-shaped form. A fly closure 53 conceals the seam disposed therebeneath.

The inner costume element 12 may be in the form of an evening gown, and is of configuration such that it is substantially concealed beneath the outer costume element 11. It includes an upper portion 60 having shoulder straps 61, a front portion 62, a rear portion 63, a waist portion 64, and a floor length skirt 65 which is maintained above the waist by the waistband 23 of the outer costume element 11, while that element is in position.

Figure 2:
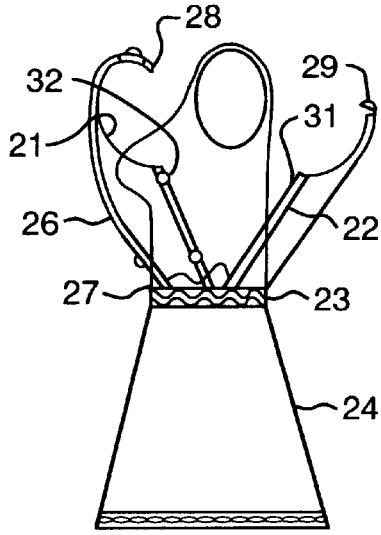
FIG. 2 is a similar schematic view showing a first stage in the removal of an outer garment element.
Figure 3:
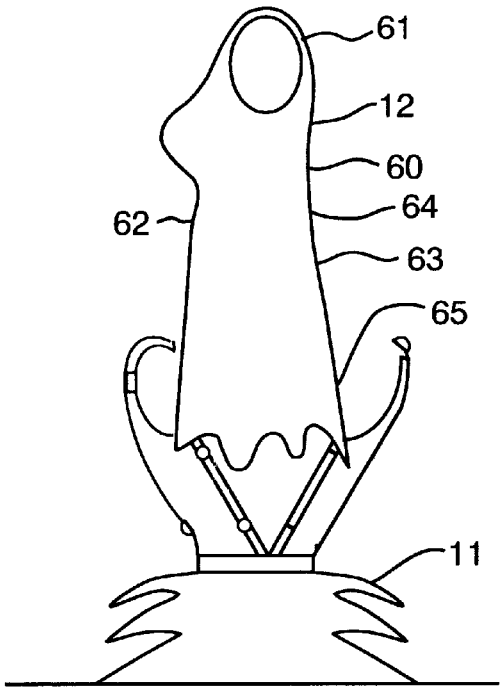
FIG. 3 is a similar schematic view showing disengagement of an outer garment from the body of a wearer, and the falling into position of an inner garment previously concealed.
Figure 4:
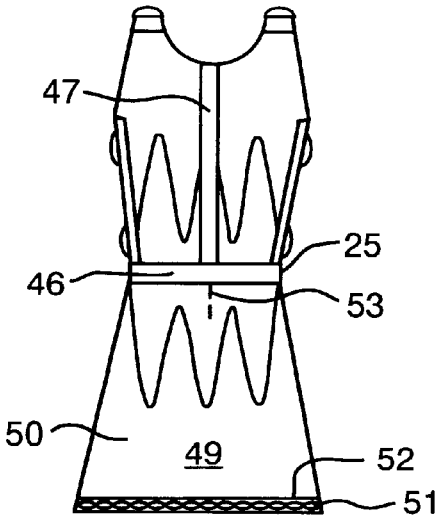
FIG. 4 is a rear elevational view showing an alternate form of construction.

Operation of the embodiment will be apparent from a consideration of FIGS. 2, 3, and 4. It is to be understood that when the outer costume element is to doffed, the wearer steps within a cloth bucket-like enclosure (not shown) which is raised by a stage assistant until the wearer is concealed.

FIG. 2 illustrates a first step in the removal of the outer garment. First, the shoulder straps 28 of the outer garment are disconnected, followed by disconnecting the side seams. The overlapping terminals 46 and verttical seam 47 are then opened.

FIG. 3 shows the outer costume element 11 dropping to the floor under the force of gravity exerted upon the weighted hem 51. Simultaneous with this action, the skirt 65 of the inner costume element 12 is released from its position above the waist of the wearer and drops to a normal position at or near a floor. When the enclosure is removed by the stage assistant, the first garment element will be contained therein.

Figure 5:
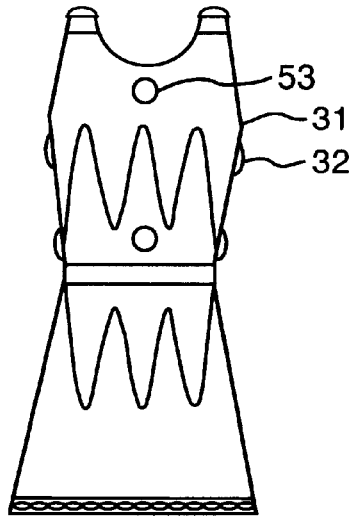
FIG. 5 is a front elevational view of the alternate form of construction.
Figure 6:
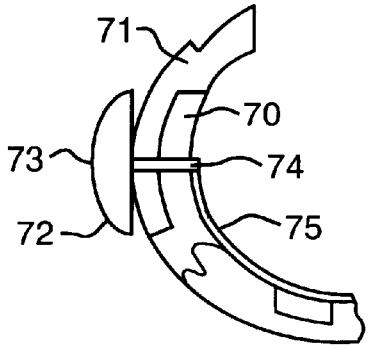
FIG. 6 is a schematic view showing an alternate form of a quick release fastener.

FIGS. 4 and 5 illustrate an alternate construction, in which the vertical seam is disposed at the rear of the outer costume element. An additional weight is included in the front portion of the skirt, and the waistband is held in position by a shank button. FIG. 6 illustrates the use of a shank button retaining means, in which a pair of overlapping portions 70 and 71 are interconnected by a plurality of shank buttons 72, each including a head portion 73 as well as a shank portion 74 forming a loop. An elongated cord 75 passes through the loops of each shank button and extends to the shoulder area of the wearer, so that when releasing the shoulder strap, the cord may be pulled to release all of the shank buttons when they become disengaged from the overlapping portions 70–71. If desired, textile loops (not shown) of material can be sewed to the inner surface of the outer costume element to provide a guide for conducting the cord up to the shoulder area of the wearer.

It may thus be seen that I have invented novel and highly useful improvements in convertible costume construction in which a user initially wears an inner costume and an outer costume, the outer costume being constructed such that it may be rapidly opened to permit it to fall under the force of gravity to uncover the inner costume. When necessary, the inner costume may be maintained above the waist of the wearer to be released to fall to normal position as the outer costume element is doffed. The use of a quick release fastener means enables the operation to be performed in a manner of seconds while the user is temporarily concealed within a flexible envelope erected by another person.

I wish it to be understood that I do not consider the invention to be limited to the precise details illustrated and disclosed in the specification, for obvious modifications will occur to those skilled in the art to which the invention pertains.

I claim:

1. A convertible costume construction for stage use for rapidly changing the appearance of a wearer comprising: an outer costume element, and an inner costume element of configuration enabling it to be worn substantially concealed by said outer costume element; said outer costume element including an upper above waist shirt having at least one interconnectible shoulder strap and at least one vertical seam extending from beneath said shoulder strap to a waist portion; and an expandable skirt interconnected to and depending from said waist portion to a lower hem, said lower hem having means for weighting, whereby upper end opening of said shoulder strap and vertical seam, with the expanding of said skirt, said outer costume may fall under gravity, to expose said inner costume element.

2. The construction in accordance with claim 1, in which said shoulder strap and vertical seam are interconnected by quick release fastening means.

3. The construction in accordance with claim 2, in which said quick release fastening means includes a plurality of shank buttons, each having a shank which projects through corresponding button holes in overlapping portions of said outer costume element, and a single cord passing through each of said shanks, of said shank buttons to retain said buttons in engaged condition, whereby pulling said cord appears to free said buttons to become disengaged from said outer costume element.

4. The construction in accordance with claim 1, in which said upper above waist shirt is of substantially sleeveless configuration.

* * * * *